United States Patent [19]

Benepe

[11] 3,939,533

[45] Feb. 24, 1976

[54] QUICK-REMOVABLE BAG CLOSURE

[76] Inventor: John A. Benepe, Rte. 2, Box 23, Shaw, Miss. 38773

[22] Filed: Dec. 13, 1974

[21] Appl. No.: 532,733

[52] U.S. Cl. ..... 24/30.5 R; 229/62

[51] Int. Cl.[2] ..... B65D 33/16; B65D 77/10

[58] Field of Search ..... 251/4; 229/62, 65; 24/7.3, 24/30.5 L, 30.5 R, 137 R

[56] References Cited

UNITED STATES PATENTS

| | | | |
|---|---|---|---|
| 662,955 | 12/1900 | McClelland | 251/4 |
| 686,899 | 11/1901 | Heroux | 229/65 |
| 1,190,713 | 7/1916 | Bokop | 251/4 X |
| 1,618,384 | 2/1927 | Morris | 24/137 R |
| 1,714,741 | 5/1929 | Urquhart | 251/4 X |
| D51,186 | 8/1917 | Pearson | 24/137 R UX |

FOREIGN PATENTS OR APPLICATIONS

| | | | |
|---|---|---|---|
| 74,516 | 12/1960 | France | 229/62 |
| 14,329 | 12/1913 | United Kingdom | 24/137 R |

*Primary Examiner*—Donald A. Griffin
*Attorney, Agent, or Firm*—Berman, Aisenberg & Platt

[57] ABSTRACT

A quick-removable closure attachment for the depending spout of a flexible hopper bag. The spout has a rigid horizontal conduit secured to its intermediate portion. To close the spout it is folded around the conduit. A holding clip has a bottom rod and a pair of gripping bars spaced upwardly from the rod, parallel thereto and located on opposite sides thereof at different heights. The bottom rod is inserted through the conduit and the folded spout is received grippingly between the gripping bars, holding the spout closed. To allow discharge from the hopper bag, the clip is withdrawn, allowing the spout to unfold and drop to its open depending position.

9 Claims, 6 Drawing Figures

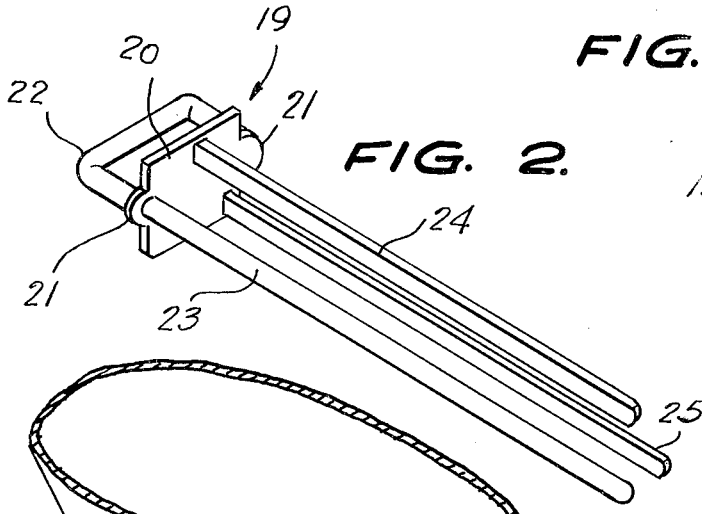
FIG. 2.
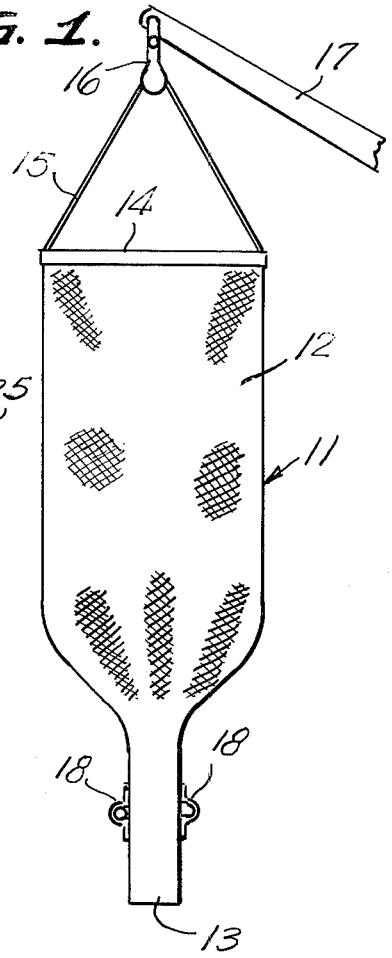
FIG. 1.
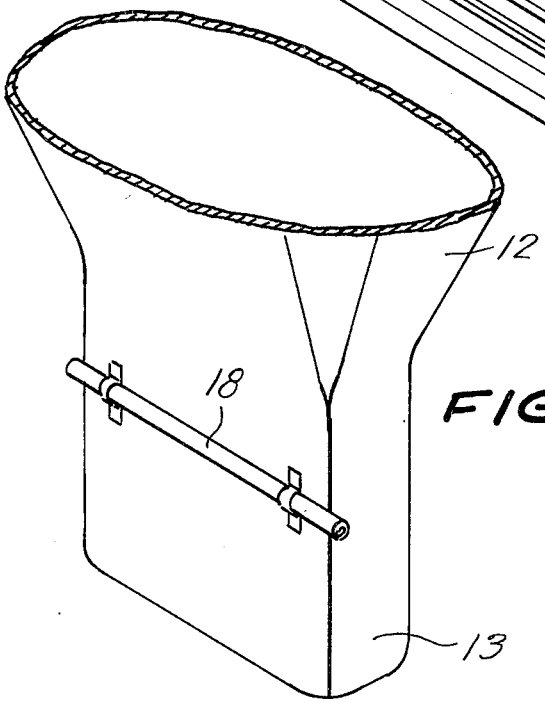
FIG. 3.
FIG. 4.
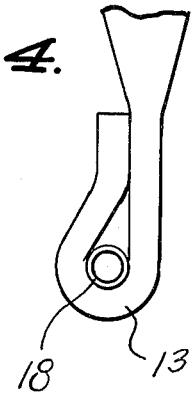
FIG. 5.
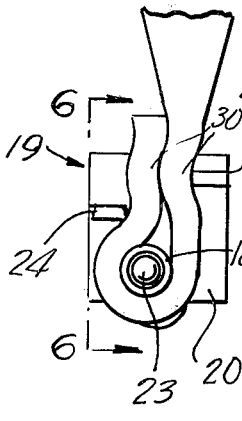
FIG. 6.
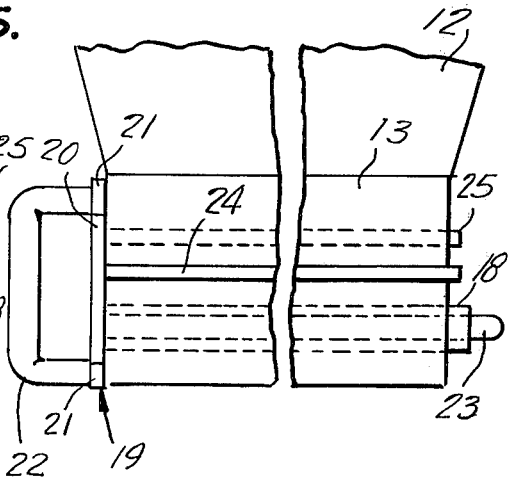

QUICK-REMOVABLE BAG CLOSURE

This invention relates to hopper bag closures, and more particularly to a quickly removable closure attachment for the depending spout of a flexible hopper bag such as a hopper bag employed to contain dusting or spraying solid materials to be employed with agricultural aircraft.

A main object of the invention is to provide a novel and improved quick-removable closure attachment for a flexible spout, such as for the dependent flexible spout of a hopper bag employed for loading agricultural aircraft, or for other types of uses where speed of operation is of primary concern, the closure attachment being very simple in construction, being easy to install on a flexible conduit, and being rapidly removable by a simple manual operation to release the conduit and allow the contents of its associated hopper bag to quickly discharge.

A further object of the invention is to provide an improved quick-removable closure attachment to facilitate the closure and fast dumping of flexible containers, such as canvas, cloth or plastic bags used to load solid materials, such as seed, fertilizers, defoliant, dust, lamp black, and the like into agricultural airplanes, or for other applications where speed of operation is of primary concern, the closure attachment being inexpensive to fabricate, being sturdy in construction, being relatively light in weight, and being generally easy to handle.

Further objects and advantages of the invention will become apparent from the following description and claims, and from the accompanying drawings, wherein:

FIG. 1 is a side elevational view of a typical flexible hopper bag suspended in operating position and having its depending spout arranged for use with a quick-removable closure attachment according to the present invention.

FIG. 2 is a perspective view, to a larger scale, of a closure attachment according to the present invention arranged for use with a hopper bag similar to that shown in FIG. 1.

FIG. 3 is an enlarged fragmentary perspective view of the spout portion of a hopper bag arranged for use with a quick-removable closure attachment such as that shown in FIG. 2, the hopper bag being slightly different from that shown in FIG. 1 in that it is provided with only a single horizontal closure guide conduit.

FIG. 4 is an enlarged fragmentary end elevational view of the spout portion of a hopper bag such as that shown in FIG. 3, shown in folded condition prior to being secured by a clip such as that shown in FIG. 2.

FIG. 5 is an end elevational view, similar to FIG. 4, but showing the clip of FIG. 2 operatively engaged with the folded spout of FIG. 4.

FIG. 6 is a front elevational view taken substantially on the line 6—6 of FIG. 5.

In certain activities, such as crop dusting, and the like, employing aircraft, or other vehicles, where speed of operation is a primary concern, it is necessary to employ rapidly operating closure devices for the hopper portions involved in transferring the material to be dispensed. In the previously employed devices, such requirements have been met by using butterfly valves, bow knots, and other relatively complex devices for the closure and dumping of bags. These devices have not been satisfactory for this purpose inasmuch as they are prone to inadvertent actuation, may be bulky in operation, and are relatively slow in action. The time of loading, particularly in aerial applications, is of the highest importance. The very nature of aerial application of materials calls for speed in order to make the operations efficient. The apparatus of the present invention is intended to provide the required expediency and speed in use for this type of activity.

Referring to the drawings, FIG. 1 illustrates a typical flexible hopper bag, shown at 11, employed for loading agricultural aircraft with spraying or dusting solid materials. The bag 11 comprises a main body portion 12 having a depending spout 13 at its bottom end and having a rigid rim 14 at its top end for the attachment of a flexible supporting element 15 which enables the bag to be suspended by means of a pivoted supporting bracket element 16 to a boom 17. The boom 17 is suitably provided with means for moving the bag 11 to a required dumping position, for example, to a position appropriate for discharging the contents of the bag into an agricultural aircraft.

The spout 13 is provided on opposite sides thereof with horizontal guide conduits 18,18, enabling the bag to be employed with a quick-removable closure attachment in a manner presently to be described.

In actual use, the spout 13 may be provided with a single guide conduit 18, for example, in the spout shown in the modification illustrated in FIG. 3. In closing the spout, preparatory to fastening it in closed position by means of a clip according to the present invention, the spout is folded around a guide conduit 18, for example, in the manner illustrated in FIG. 4. The use of guide conduits on opposite sides of the spout enables the fold to be made in either direction.

Referring now to FIG. 2, a typical quick-removable closure clip according to the present invention is designated generally at 19. The clip 19 comprises a rigid plate-like main body 20 formed with opposite end lugs 21,21 to which are secured the respective opposite end legs of a U-shaped handle 22. Rigidly secured to the plate-like member 20 is a rigid guide rod 23 of substantial length and dimensioned so as to be slidably receivable in a guide conduit 18. Also rigidly secured to the plate-like main body member 20 on opposite sides of the common plane of rod 23 and handle 22 are respective rigid gripping bar elements 24 and 25, the bar elements 24 and 25 being spaced upwardly from the guide rod 23 at different heights, as viewed in FIG. 5, and extending parallel to the rod member 23. It will be further seen from FIGS. 2 and 5 that the bar members 24 and 25 are in the form of flat strips and arranged horizontally, in the orientation of the device 19 shown in FIG. 5. The bar members 24 and 25 are of sufficient length to completely span the width of a spout 13, and are of the same order of length as the guide rod 23, although the guide rod 23 is preferably somewhat longer than the gripping bars 24 and 25.

In using the clip 19, the spout 13 is folded around a guide conduit 18 horizontally secured thereto in the manner illustrated in FIG. 4, to a flattened folded condition, wherein the free end of the spout extends upwardly, after which the guide rod 23 of a clip 19 is inserted in the conduit 18 with the folded upwardly adjacent portions of the spout received between the gripping bars 24 and 25. Thus, the device 19 is engaged laterally with the folded spout 13 until the plate-like main body member 20 comes into abutment with the folded side edge portion of the spout, as shown in FIG.

6. It will be noted that the lowermost bar element 24 is spaced sufficiently from the guide rod 23 to receive the thickness of a flattened spout 13 between rod 23 and bar 24 and that the other bar 25 is spaced upwardly relative to the lowermost bar 24 to deform the flattened spout portions slightly in a leftward direction, as viewed in FIG. 5, and as shown at 30. This provides a secure gripping action which securely maintains the folded flattened spout 13 in a sealing condition.

When the loaded bag 11 is moved into position by the action of boom 17 over the intended receiving receptacle, such as the receiving hopper of an agricultural aircraft, the clip 19 may be quickly withdrawn by merely exerting a horizontal pull thereon employing the handle 22 to disengage the guide rod 23 and the gripping bars 24, 25 from the folded spout 13. When the spout is thus disengaged from the clip 19, it drops to a depending vertical position and opens to allow the contents of the bag 11 to discharge into the desired receptacle. This action can be performed very rapidly and with a minimum amount of manual effort.

While a specific embodiment of a quick-removable closure attachment for the depending spout of a flexible hopper bag has been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. A flexible hopper bag having a dependent spout, and a guide conduit horizontally secured on an intermediate portion of the spout, in combination with a closure clip for the bag spout, said clip comprising a rigid main body member, a guide rod rigidly secured to said body member, and a pair of gripping bar elements rigidly secured to said body member and extending substantially parallel to said guide rod, spaced upwardly therefrom and located on opposite sides thereof, said guide conduit slidably receiving said guide rod and the folded flattened spout being grippingly received between said gripping bar elements when the spout is flattened and folded around said guide conduit and the guide rod is inserted in the conduit, whereby the spout may be at times released to drop to a depending open condition when the clip is disengaged therefrom.

2. The combination of claim 1, and wherein the gripping bar elements are located at different heights above the guide rod. outwardly

3. The combination of claim 1, and wherein said bar elements are in the form of flat strips.

4. The combination of claim 1, and wherein said body member comprises a plate and said guide rod and gripping bar elements extend perpendicular to said plate.

5. The combination of claim 4, and a U-shaped handle projecting outwardly from said plate.

6. The structural combination of claim 1, and wherein the gripping bar elements are at different heights above the guide rod, the lowermost bar element being located adjacent to the guide rod and being spaced therefrom sufficiently to receive the thickness of the flat spout between the guide conduit and said lowermost bar element.

7. The structural combination of claim 1, and an additional guide conduit horizontally secured on the intermediate portion of the spout opposite the first-named guide conduit, enabling the spout to be folded upwardly around either guide conduit for gripping engagement by the clip.

8. A quickly attachable and detachable closure clip for a flexible hopper bag spout such as used for loading agricultural aircraft, or the like, comprising a rigid thin plate member, an elongated guide rod considerably longer than any dimension of said plate member and of sufficient length to completely span the width of and be received in the fold of a bag spout when such spout is flattened and folded upwardly, said guide rod being rigidly secured to said plate member to extend substantially perpendicular thereto from one side surface thereof, a pair of similarly elongated gripping bar elements rigidly secured to the same side of said plate member and extending substantially parallel to said guide rod, spaced upwardly therefrom and located on opposite sides thereof, and a handle member projecting outwardly from the opposite side of said plate member, whereby a folded flexible hopper bag spout may be grippingly received between said gripping bar elements to close the bag spout and the bag spout may be quickly released to a depending opening condition when the clip is disengaged therefrom.

9. The clip of claim 8, wherein said bar elements are flat strips terminating in rounded free ends to facilitate application to a fold hopper bag spout and are located at different heights above the guide rod.

* * * * *